US008510928B2

(12) United States Patent
Rauch

(10) Patent No.: US 8,510,928 B2
(45) Date of Patent: Aug. 20, 2013

(54) STAINLESS STEEL WRAP ASSEMBLY AND METHOD OF DECORATING A MONUMENT USING THE SAME

(75) Inventor: Jamison Rauch, Roseville, IL (US)

(73) Assignee: Brandon Jason Bentz, Roseville, IL (US)

( * ) Notice: Subject to any disclaimer, the term of this patent is extended or adjusted under 35 U.S.C. 154(b) by 291 days.

(21) Appl. No.: 13/007,801

(22) Filed: Jan. 17, 2011

(65) Prior Publication Data

US 2012/0180289 A1 Jul. 19, 2012

(51) Int. Cl.
*B23P 11/02* (2006.01)

(52) U.S. Cl.
USPC ..... 29/453

(58) Field of Classification Search
USPC ..... 29/428, 432.1, 432.2, 445, 453, 401.1, 29/525.01, 525.14; 52/103, 3; 40/124.5, 40/124.2
See application file for complete search history.

(56) References Cited

U.S. PATENT DOCUMENTS

| | | | | |
|---|---|---|---|---|
| 221,969 | A | | 11/1879 | McMinn et al. |
| 314,019 | A | | 3/1885 | Harroun |
| 498,506 | A | | 5/1893 | Cameron |
| 2,095,290 | A | | 10/1937 | Roy |
| 2,525,091 | A | | 10/1950 | Brownawell |
| 3,648,422 | A | * | 3/1972 | Tate, Jr. ..... 52/104 |
| 3,726,052 | A | | 4/1973 | Thompson |
| 4,550,537 | A | | 11/1985 | Smith |
| 6,173,539 | B1 | | 1/2001 | Barnes |
| 6,467,222 | B2 | | 10/2002 | Barnes |

* cited by examiner

*Primary Examiner* — John C Hong
(74) *Attorney, Agent, or Firm* — Zarley Law Firm, P.C.

(57) ABSTRACT

A stainless steel wrap assembly and method of decorating a monument using the same. When fabricated the stainless steel wrap assembly to have a predetermined decorative design and predetermined size that compliments the size and shaped of a preexisting monument. The wrap is then placed over the monument and attached thereto such that the wrap incorporates features of the preexisting to provide one single view for an observer.

13 Claims, 3 Drawing Sheets

STAINLESS STEEL WRAP ASSEMBLY AND METHOD OF DECORATING A MONUMENT USING THE SAME

BACKGROUND OF THE INVENTION

This invention relates to monuments and headstones. More specifically, this disclosure relates to the use of stainless steel to provide a decorative look to preexisting monuments, markers, and headstones.

Monuments have been used for many years in dedication of a person or an event. For example, monuments including headstones have been used to mark an individual's final resting spot for many years. Typically the monument is made of granite, marble or limestone and provides engraved markings including the name of the individual that has been deceased and other information.

While these monuments have been used for many years many problems remain with such monuments. In particular, the granite, marble or limestone can become worn from weather is difficult to work and can typically have a dull appearance. To this end, monuments can become worn where recognizing the name or information regarding a passed loved one becomes difficult. Thus, a need in the art exists for a system and method to enhance the appearance of present monuments.

Thus, a principal object of the present invention is to provide a method of decorating a monument that enhances the aesthetic appearance of the monument.

Yet another object of the present invention is to provide a wrap assembly and method for using the same that is more resistant to weather and outside elements.

These and other objects, features, or advantages of the present invention will become apparent from the specification and claims.

BRIEF SUMMARY OF THE INVENTION

A method for decorating a monument that includes manufacturing a stainless steel wrap assembly that has a frame with a predetermined design. The frame has the size and shape of a preexisting monument such that the stainless steel wrap assembly can be placed over the preexisting monument such that the frame surrounds a perimeter of the preexisting monument. Once in place the preexisting monument is seen through the stainless steel wrap such that the wrap and monument together provide a single aesthetically pleasing presentation for a viewer.

DETAILED DESCRIPTION OF THE PREFERRED EMBODIMENT

Figure 1:
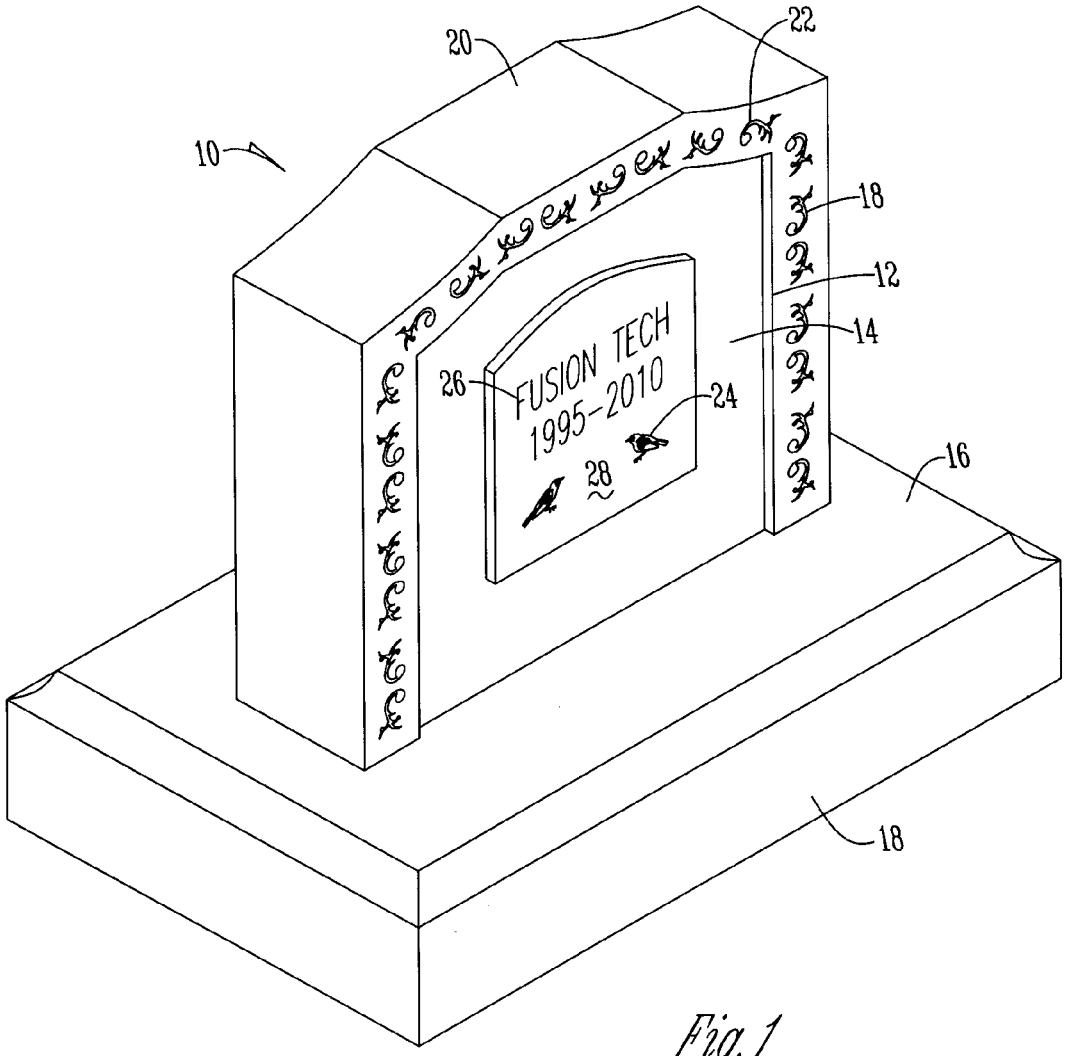
FIG. 1 is a side perspective view of a wrap assembly.
Figure 2:
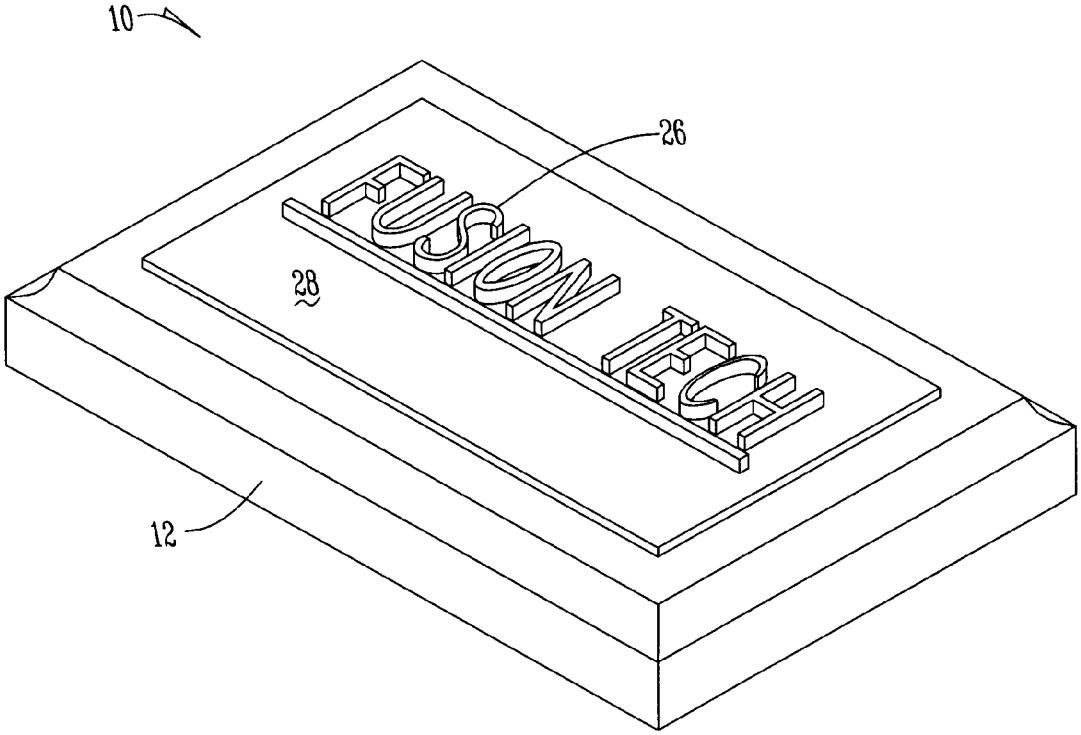
FIG. 2 is a side perspective view of a plate assembly.
Figure 3:
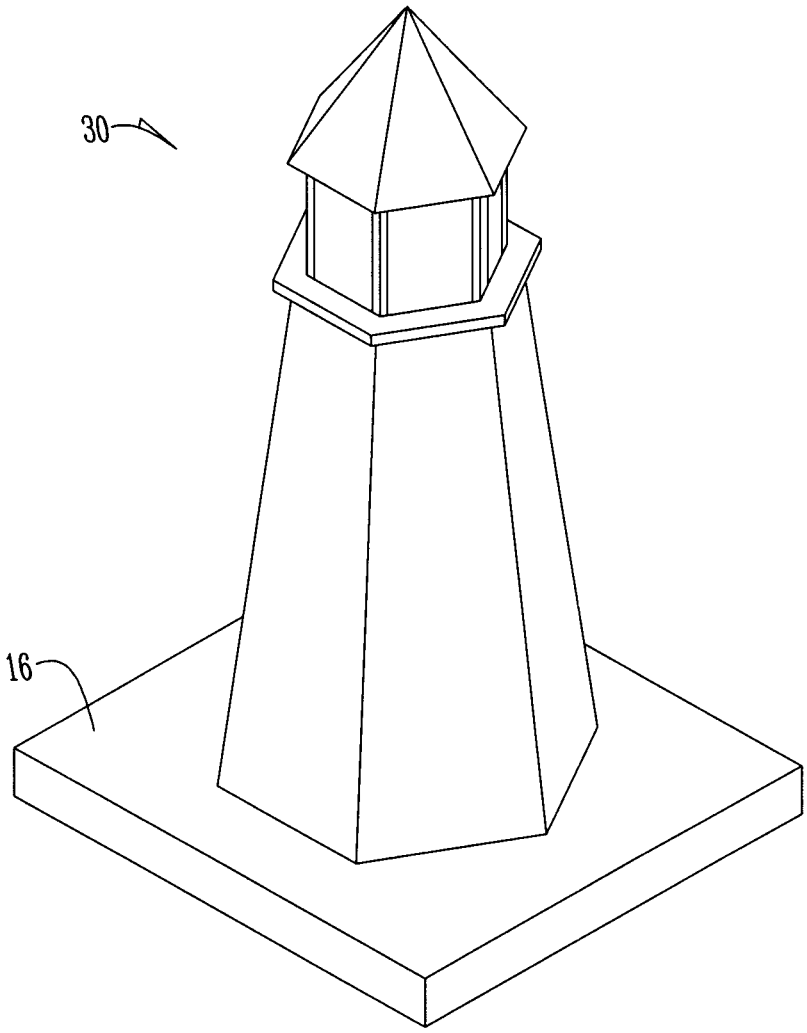
FIG. 3 is a side perspective view of a monument assembly.

FIG. 1 shows a stainless steel wrap assembly 10 that is placed on a preexisting monument 12 that includes a headstone 14 attached to a base 16. The preexisting monument 12 is made of traditional granite, marble, limestone media or the like as is currently used in the monument industry. The monument includes a perimeter 18 including a perimeter 18 around the headstone 14 and base 16.

The monument assembly 10 includes a frame 20 that is of size and shape that compliments the size and shape of the headstone 14 of the monument 12 such that the frame 20 may be slidably placed over the headstone 14. The frame 20 can include pipe, tubing, pipe caps, angle iron, bar products and the like that may be welded and manufactured by preexisting methods including the use of fabrication, spray arch, machining, water jet, laser cutting etching, or the like to present a graphic design 22, picture 24, lettering 26 or the like.

A plate assembly 28 can be used in combination with the frame 20 to provide additional graphic design, pictures, lettering or the like to provide a more aesthetically pleasing assembly 10 for a viewer. Alternatively, the plate assembly 28 may be attached to a preexisting monument 12 without use of the frame 20 to again, provide a more aesthetically pleasing monument 12.

In an alternate embodiment, a three dimensional stainless steel monument assembly 30 on a base 16 may be provided. The stand alone stainless steel monument assembly 30 utilizes a plurality of stainless materials in the shape of the design including pipe, tubing, pipe caps, angle iron, bar products and the like to provide the monument assembly 30 with shape and depth. The engraving and lettering processes for the assembly 10 and monument 12 are done with an arch cam or surf cam style programming in association with an end metal cutting device that machines out the letters in order to provide a multi surface appearance. The frame 20 and plate assembly 28 or standing monument 30 is fastened to a granite base with a locking mechanism that is a stud that is fastened to the granite base or alternatively epoxy.

In operation, a stainless steel wrap assembly 10 having a frame 20 and/or plate assembly 28 is manufactured with decorative designs, lettering, etchings and the like. The wrap assembly 10 is also manufactured to be the size and shape similar to a preexisting monument 12 so that the frame 20 may be slidably attached to the monument 12 and secured. At the same time the plate assembly 28 is also attached to the monument 12 thus providing a combination of the wrap assembly 10 and monument 12 that incorporates the features of the monument 12 to be seen by a viewer as a single design.

As a result of the stainless steel a more aesthetically pleasing, sharp looking monument 12 is presented. In addition, the stainless steel lasts longer and is not as susceptible to weathering as the material of the monument 12. The assembly 10 is easily manufactured to provide a cost effective upgrade to preexisting monuments 12. Thus, at the very least all of the stated objectives have been met.

It will be appreciated by those skilled in the art that other various modifications could be made to the device without departing from the spirit and scope of this invention. All such modifications and changes fall within the scope of the claims and are intended to be covered thereby.

What is claimed is:

1. A method of decorating a monument steps comprising:

manufacturing a stainless steel wrap assembly having a frame with a predetermined design;

said frame having a size and shape that complements the size and shape of a preexisting monument;

slidably placing the stainless steel wrap assembly over the preexisting monument such that the frame surrounds a perimeter of the preexisting monument;

wherein once in place the preexisting monument is seen through the stainless steel wrap.

2. The method of claim 1 wherein the frame has pipe and pipe caps.

3. The method of claim 1 wherein the frame has tubing.

4. The method of claim 1 wherein the frame has angle iron.

5. The method of claim 1 wherein the stainless steel wrap assembly includes machined letters.

6. The method of claim 1 further comprising the steps of locking the stainless steel wrap to the preexisting monument with a locking mechanism.

7. The method of claim 1 wherein the stainless steel wrap assembly has a plurality of welded components.

8. The method of claim 1 further comprising the step of securing a plate assembly to the preexisting monument.

9. The method of claim 8 wherein the plate assembly is stainless steel.

10. The method of claim 9 wherein the plate assembly has etchings therein.

11. The method of claim 1 wherein the step of manufacturing the stainless steel wrap assembly includes machining the stainless steel wrap assembly.

12. The method of claim 1 wherein the step of manufacturing the stainless steel wrap assembly includes fabricating the stainless steel wrap assembly.

13. The method of claim 1 wherein the step of manufacturing the stainless steel wrap assembly includes use of a laser or a waterjet.

* * * * *